US008196273B2

(12) United States Patent
Anscher

(10) Patent No.: US 8,196,273 B2
(45) Date of Patent: Jun. 12, 2012

(54) QUICK RELEASE BUCKLE ASSEMBLY

(75) Inventor: Joseph Anscher, Muttontown, NY (US)

(73) Assignee: National Molding LLC, Miami Lakes, FL (US)

( * ) Notice: Subject to any disclaimer, the term of this patent is extended or adjusted under 35 U.S.C. 154(b) by 380 days.

(21) Appl. No.: 12/590,170

(22) Filed: Nov. 3, 2009

(65) Prior Publication Data

US 2011/0099776 A1 May 5, 2011

(51) Int. Cl.
*A44B 11/25* (2006.01)

(52) U.S. Cl. ..... 24/606; 24/614; 24/615; 24/265 BC; 24/310; 24/312; 24/573.11

(58) Field of Classification Search ..... 24/68 E, 24/307, 310, 312, 163 R, 265 BC, 573.11, 24/602, 115 F, 456, 614, 615, 701, 606, 616, 24/625

See application file for complete search history.

(56) References Cited

U.S. PATENT DOCUMENTS

| | | | | |
|---|---|---|---|---|
| 3,200,463 | A | 8/1965 | Craven et al. | |
| 5,275,437 | A | 1/1994 | Moedinger et al. | |
| 5,465,472 | A | 11/1995 | Matoba | |
| 5,794,316 | A | 8/1998 | Anscher | |
| 5,832,573 | A | 11/1998 | Howell | |
| 6,487,761 | B2 * | 12/2002 | Van Tassel | 24/606 |
| 6,931,695 | B2 * | 8/2005 | Anscher | 24/614 |
| 7,073,234 | B2 | 7/2006 | Turpin | |
| 7,096,545 | B2 | 8/2006 | Uehara et al. | |
| 7,243,376 | B2 | 7/2007 | Johnson | |
| 7,448,116 | B1 * | 11/2008 | Howell | 24/614 |
| 2002/0092140 | A1 * | 7/2002 | Van Tassel | 24/614 |
| 2005/0132545 | A1 | 6/2005 | Anscher | |
| 2010/0313392 | A1 * | 12/2010 | Anscher | 24/616 |
| 2011/0030180 | A1 * | 2/2011 | Parisi et al. | 24/611 |
| 2011/0219590 | A1 * | 9/2011 | Anscher | 24/606 |
| 2011/0239419 | A1 * | 10/2011 | Carter | 24/606 |

FOREIGN PATENT DOCUMENTS

| | | |
|---|---|---|
| DE | 1 849 648 | 4/1962 |
| DE | 10 2007 058 124 | 6/2009 |
| WO | WO 2008/094280 | 8/2008 |
| WO | WO 2009/047790 | 4/2009 |
| WO | WO 2009/134608 | 11/2009 |

OTHER PUBLICATIONS

European Search Report in English.
European Search Report dated Aug. 20, 2010.

* cited by examiner

*Primary Examiner* — Robert J Sandy
*Assistant Examiner* — Tyler Johnson
(74) *Attorney, Agent, or Firm* — Collard & Roe, P.C.

(57) ABSTRACT

A quick release buckle assembly has a male portion and a female portion. The male portion is inserted into the female portion to lock the buckle assembly together. The male buckle portion is connected to a cable. Pulling the cable with sufficient force causes the male portion to release from the female portion. Several buckle assemblies can be simultaneously released if the cables are connected to a single handle. Pulling on the handle then releases all of the male portions at once.

16 Claims, 6 Drawing Sheets

QUICK RELEASE BUCKLE ASSEMBLY

BACKGROUND OF THE INVENTION

1. Field of the Invention

This invention relates to a quick release buckle assembly. In particular, the invention relates to a quick-release buckle assembly that can be used on articles of clothing such as cut away vest that need to be quickly and easily removed by the wearer.

2. The Prior Art

Cut away vests are often worn by members of the military and law enforcement agencies to aid the wearer in carrying gear, as well as to protect against bullets and other impacts. These vests, especially when loaded with armor plating, can be very heavy and cumbersome to wear. Therefore it is a requirement that the vests be easily removable by the wearer, in case the wearer must be mobile in an emergency, and especially in case of submersion in water.

In the past, these vests have been constructed of several separate pieces that are held together by a cable system. An example of this system is shown in U.S. Pat. No. 7,243,376 to Johnson. A strap is threaded through each piece, with a hole in each strap. The holes are then lined up, and a cable is threaded through each hole. A loop on one of the pieces is threaded through the overlapping holes, and a cable is then fed through the loop, keeping all of the pieces joined together. In an emergency, the cable is pulled out, thus releasing all of the pieces simultaneously. This system works well to free the wearer from the vest, but it is extremely difficult to re-assemble the vest after use, so the vests are generally discarded after a single use.

A quick-release buckle system is described in U.S. Pat. No. 6,487,761. In this buckle, a cable system is directly attached to the locking legs of the male portion of the buckle so that pulling the cable pulls the legs inward. This buckle has the disadvantage that it is difficult to mold, and it compromises the strength of the locking legs, because they have to be made especially flexible to be able to be moved by the cable.

SUMMARY OF THE INVENTION

It is therefore an object of the invention to provide a quick-release buckle system that can be used on articles of clothing that need to be quickly removed, such as a cut away vest, so that the vest can be re-used for further operations. A version of this cut-away vest is described in U.S. patent application Ser. No. 12/456,069, the disclosure of which is herein incorporated by reference. It is another object of the invention to provide a quick-release buckle system that is easy to manufacture and can withstand large forces without breaking.

These and other objects are achieved by a quick release buckle assembly having a male portion that is inserted into a female portion. Each male buckle portion is connected to a cable. A sharp pull on the cable causes the male portion to release from the female portion to separate the buckle assembly.

Each female portion comprises a hollow body with a front wall, a back wall, an open top, a cavity between the front and back walls and at least one locking slot extending through the hollow body and communicating with the cavity. Each male portion comprises a base with at least one locking leg, such that inserting the male part into the open top of the female part causes the locking leg to engage the locking slot to lock the male portion to the female portion, as is the case with traditional side-release buckles. The operation of a traditional side-release buckle, such as that described in U.S. Pat. No. 5,794,316, is well known and not described in detail here. In one embodiment, there are two locking slots and two locking legs, disposed on opposite sides of the male and female buckle portions, respectively. The male portion also be released in the traditional manner: by pinching the locking legs together from outside the female buckle portion until they clear the locking slots in the female portion. However, the buckle used in the present invention has an additional feature: In this buckle, there are means for moving the locking legs inward to release the male portion from the female portion when a cable is pulled.

The means for moving the locking leg toward the central leg can comprise a separate release assembly that is positioned at the tip of the locking legs. The release assembly is a separate piece that is not connected to the locking legs. The release assembly is slidable toward the base of the male portion. This sliding movement causes the locking legs to be pinched inward to release them from the locking slots of the female portion.

The release assembly comprises a horizontal bar with two arms that extend down toward the base of the male portion, so that the release assembly wraps around the tips of the locking legs. The arms have a slanted inner contour, which slants outwards toward the base of the male portion. The locking legs have a rounded or slanted tip, which widens toward the legs, corresponding to the outward slant of the arms of the release assembly. Sliding the release assembly toward the base causes the arms to slide along the tips of the locking legs and press the locking legs inward until they clear the locking slots of the female portion. The tips of the locking legs have a locking element at their widest point, to catch on the edge of the locking slots to keep the male portion firmly secured to the female portion until the release assembly is slid down to press the legs inward.

In one embodiment, the release assembly is connected to a cable running through the male portion, so that pulling the cable causes the release assembly to slide toward the base and push the locking legs inward. In a preferred embodiment, the cable extends through a central leg of the male portion and attaches at a central point of the release assembly. The release assembly can have a cable guide that extends into a channel in the central leg. The cable then connects to the cable guide. This arrangement ensures that the release assembly does not move out of the plane of the buckle assembly, and only moves in its designated sliding direction.

Insertion of the cable into the cable guide is a simple procedure. To attach a cable to the buckle, the release assembly is fully depressed, so that the locking legs are squeezed together. At this point, the end of the cable guide is pushed through the central leg of the male portion and extends beyond the central leg. The cable has an enlarged end section, which is placed in an aperture at the end of the cable guide to secure the cable to the cable guide. The aperture is connected to the end of the cable guide by a slot through which the cable extends. The release assembly is then released back into its resting position, with the cable secured in the cable guide. The cable can then be easily removed in the same way. The release assembly can be fully depressed to reveal the end of the cable in the cable guide. The end is then lifted out of the aperture in the cable guide so that it is released from the cable guide. This feature is particularly helpful when the buckle needs to be replaced in a multiple-buckle system. The rest of the system is not affected, and faulty or broken buckles can be easily replaced.

The buckle assembly according to the invention has the advantage that several buckle assemblies can be connected via their cables, so that a single pull can release all of the connected buckle assemblies at the same time. For example, the cables of each of the male portions can be attached to a single handle, so that pulling the handle releases all of the buckle assemblies simultaneously. This allows a device that is being held together by several buckles to be immediately disassembled with a single motion.

For example, the buckle assembly could be used to secure the front and back sections of a cut away vest to each other, as described in U.S. patent application Ser. No. 12/456,069. Pulling the handle causes all of the male portions to simultaneously release from the female portions and release the front portion of the vest from the rear portion, allowing the wearer to be immediately freed from the vest.

In another embodiment, the base of the male buckle portion has a strap securing bar that is connected to the base at one end, and has a releasable latch at the other end. The latch can be secured in an aperture on the base of the male portion to create a secure strap bar on the end of the male portion. This way, the male portion can be attached to a length of webbing without needing a free end of the webbing to thread through a bar on the buckle. This is especially important if the buckle is to be secured to a military vest, because these vests often only have webbing that is secured to the vest on both ends.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 1:
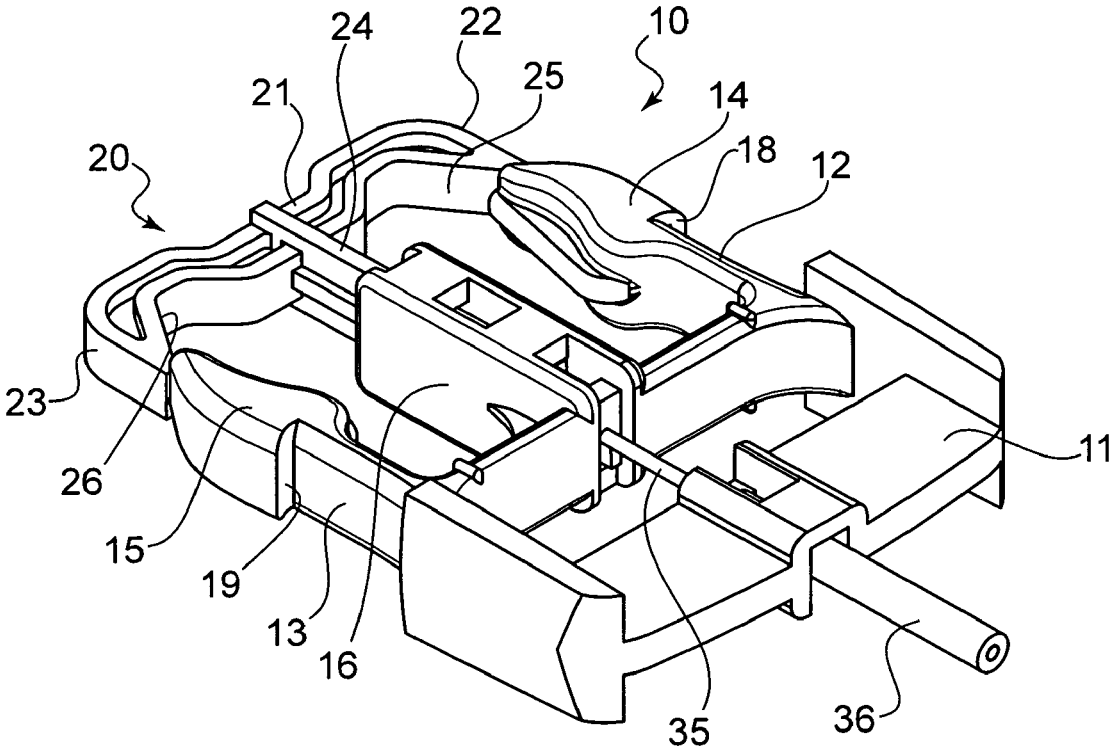
FIG. 1 shows a perspective view of the male buckle portion according to one embodiment of the invention.

Referring now in detail to the drawings, FIGS. 1-7 show a male buckle portion 10 according to an embodiment of the invention. Male buckle portion 10 has a base 11, and two locking legs 12, 13. Each locking leg 12, 13 has a locking element 14, 15, on its respective end. Extending from base 11 is a hollow central leg 16, through which a cable 35 extends. Cable 35 is connected to a release assembly 20, which forms a separate piece from male buckle portion 10. A cable sheath 36 can surround cable 35 outside male portion 10 so the cable sheath 36 can be attached to a structure and cable 35 can slide within cable sheath 36 to operate the buckle assembly.

Release assembly 20 has a horizontal base 21 and two arms 22, 23 extending back toward base 11 of male buckle portion 10. Extending down from horizontal base 21 is a cable guide 24 that inserts into a channel 19 in central leg 16 of male buckle portion 10. Cable 35 extends into central leg 16 and attaches to cable guide 24 of release assembly 20.

Figure 6:
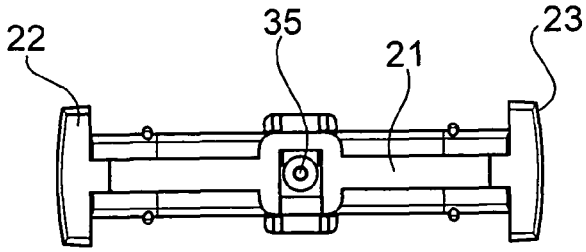
FIG. 6 shows a top view of the buckle portion of FIG. 1.

Arms 22, 23 of release assembly 20 have a slanted interior surface 25, 26 which is angled outward toward the ends of arms 22, 23, so that the inner contour of release assembly 20 widens as it extends away from horizontal base 21. Locking elements 14, 15 have a curved structure that widens from the tip to the bottom of locking elements 14, 15, which ends in ledges 18, 19. Ledges 18, 19 serve to secure locking elements 18, 19 within locking slots 31 of a corresponding female buckle portion 30, such as shown in FIG. 6.

Figure 3:
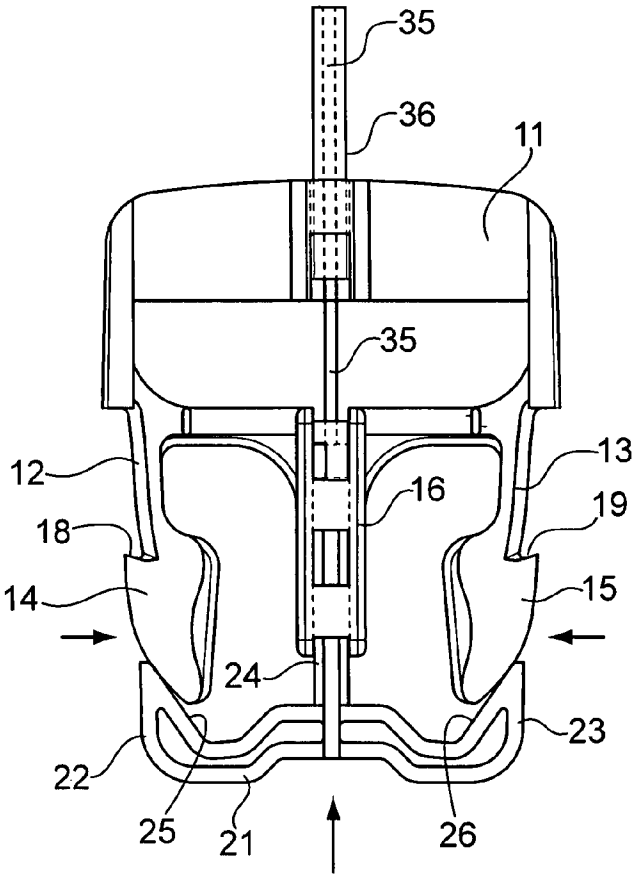
FIG. 3 shows a top view of the buckle portion of FIG. 1 with the release assembly slid toward the base.
Figure 2:
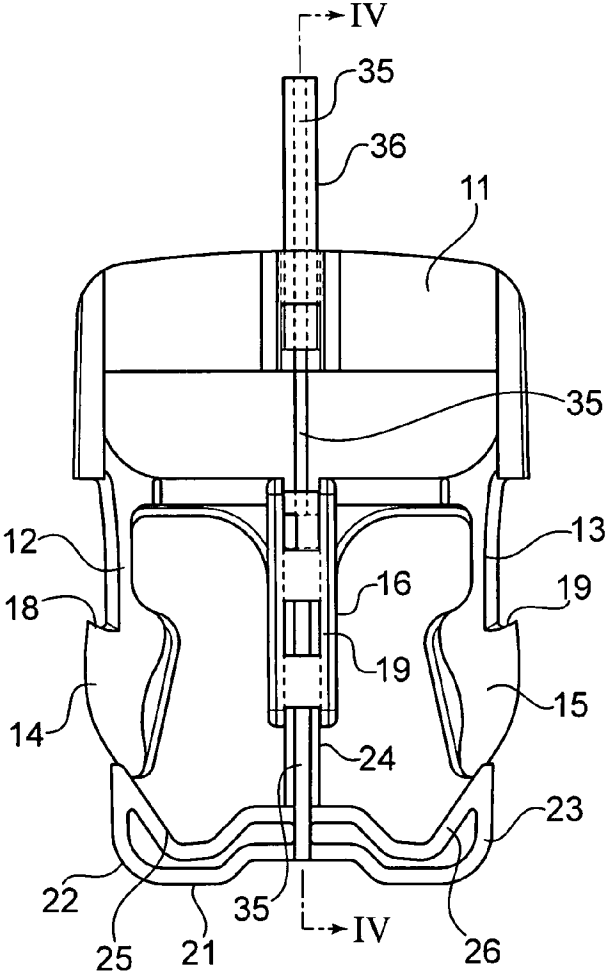
FIG. 2 shows a top view of the buckle portion of FIG. 1.

In use, when cable 35 is pulled, release assembly 20 is pulled toward base 11 and presses against locking elements 14, 15 of male portion 10. The slanted inner surfaces 25, 26 slide along the curved outer surface of locking elements 14, 15 and press locking elements 14, 15 inward as the inner contour of release assembly 20 narrows toward the top, as shown in FIG. 3. Once release assembly 20 has been fully lowered, locking legs 12,13 have been sufficiently pressed inward to allow locking elements 14, 15 to clear locking slots 31 of female buckle portion 30. At this point, male portion 20 is released from female portion 30 and is pulled out by the force on cable 35. Female portion 30 is configured similar to female buckle portions on standard side-release buckles, except that extra room is made to accommodate release assembly 20 inside its cavity, as shown in FIG. 6.

Figure 5:
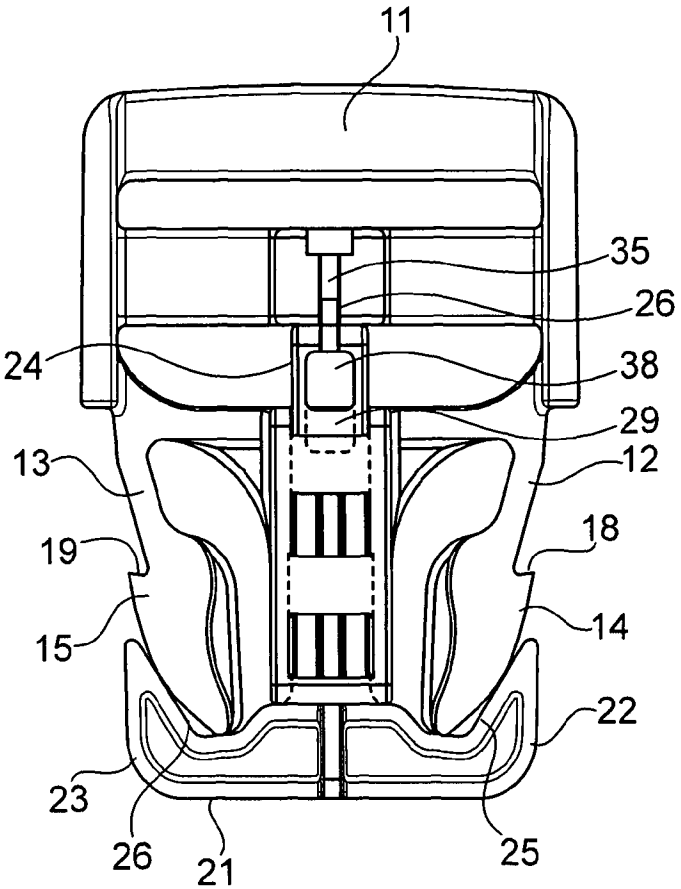
FIG. 5 shows a bottom view of the buckle portion shown in FIG. 4.
Figure 4:
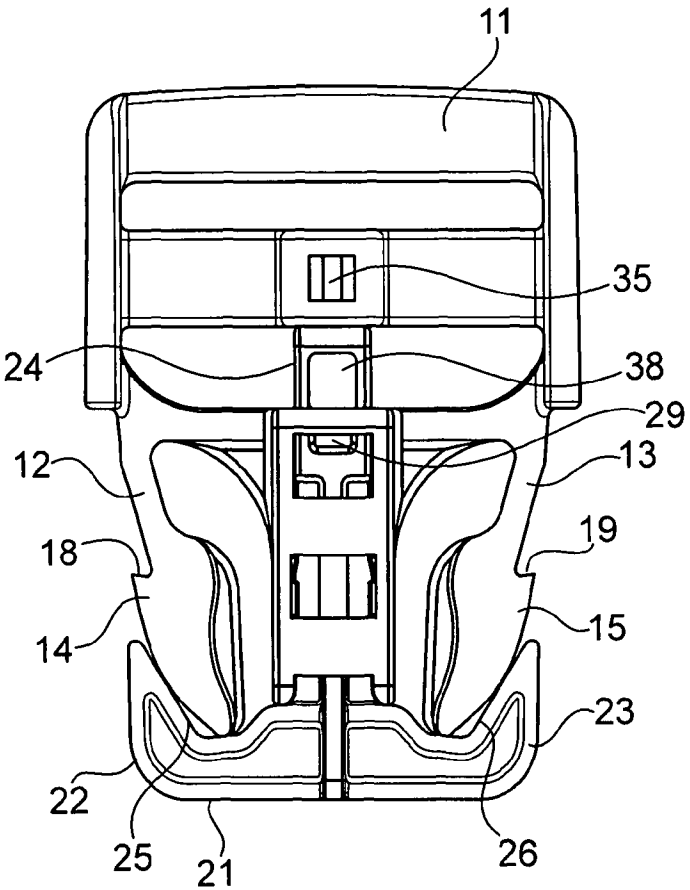
FIG. 4 shows a top view of the buckle portion of FIG. 1 with the release assembly in a fully depressed position.

As shown in FIGS. 4 and 5, cable 35 can be easily inserted and disengaged from male portion 10, so that a buckle can be replaced at any time. To insert cable 35, release assembly 20 is placed into a fully depressed position, as shown in FIG. 4. This exposes aperture 29 in cable guide 24 which is accessible through a slot 26 at the end of cable guide 24. At this point cable 35, which has enlarged end portion 38, is placed in slot 26 so that enlarged end portion 38 rests within aperture 29. Enlarged end portion 38 is wider than slot 26 so it cannot slide out of cable guide 24. Release assembly 20 is then released so that it slides back up into central leg 16 of male buckle portion 10. Since slot 26 is now concealed within central leg 16, cable 35 cannot be removed, and cable 35 is securely attached to cable guide 24. However, cable 35 can be easily removed from cable guide 24 by depressing release assembly 20 until slot 26 and aperture 29 clear central leg 16, and cable 35 can be simply lifted out of cable guide 24. This allows defective or broken buckles to be replaced without having to replace the cable or any other parts of the object to which the cable is attached.

Figure 7:
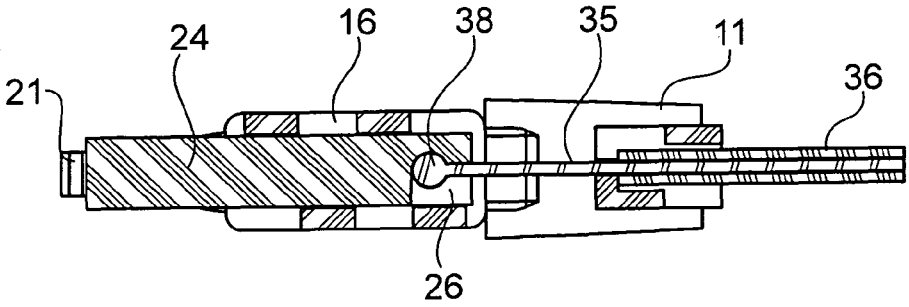
FIG. 7 shows a side cross-sectional view along lines IV-IV of FIG. 2.
Figure 8:
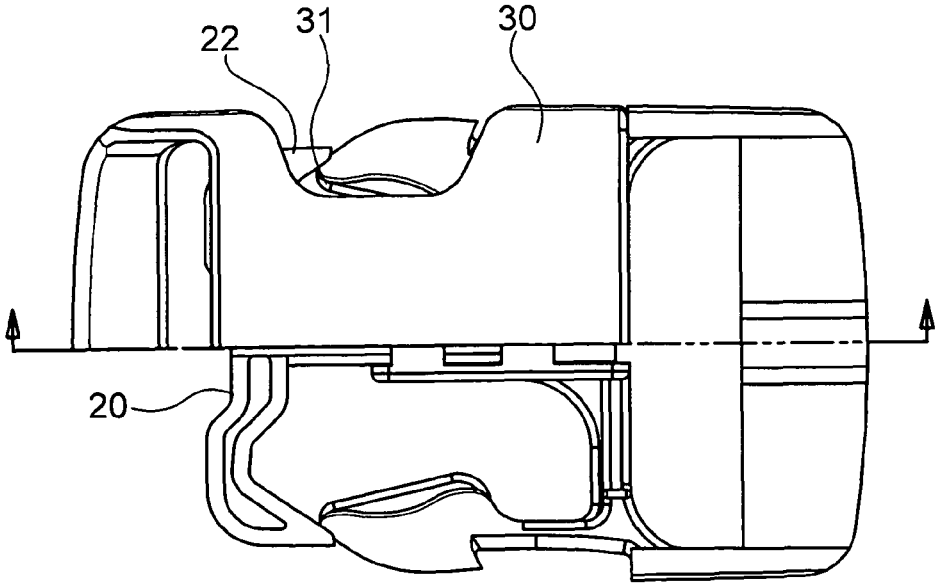
FIG. 8 shows a top view of one embodiment of the entire buckle assembly, with half of the female portion cut away.
Figure 9:
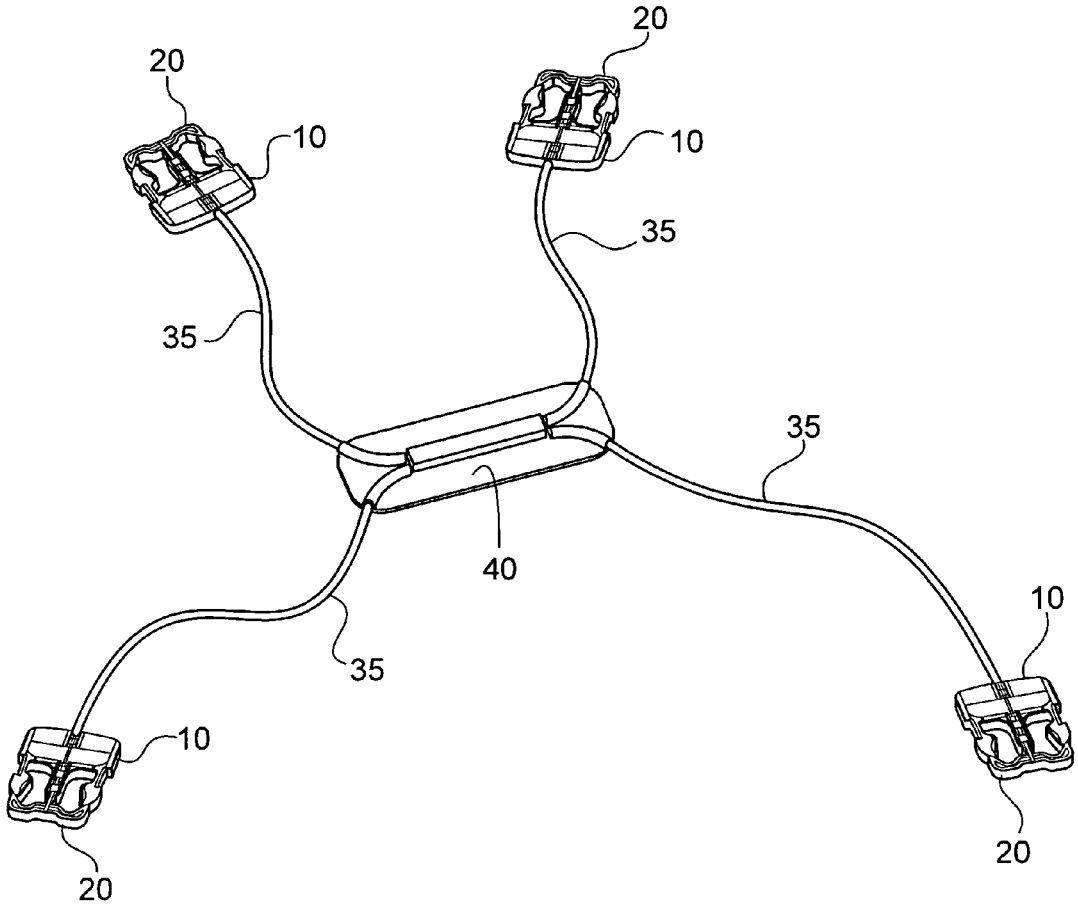
FIG. 9 shows a buckle system comprising several male portions of the buckle assembly according to the invention.

The buckle assembly of the present invention can be used in a multiple-buckle system, where several buckles need to be released simultaneously. In the system, which is shown in FIG. 7, several male portions 10 with their release assemblies 20 are connected to cables 35, which are all connected to a single handle 40. A hard pull on handle 40 pulls all four cables 35, which simultaneously causes all of release assemblies 20 to slide down and release the locking legs from the corresponding female buckle portions 30. This system is ideal for a cut-away vest such as described in U.S. patent application Ser. No. 12/456,069, but can also be used for many other applications.

Figure 10:
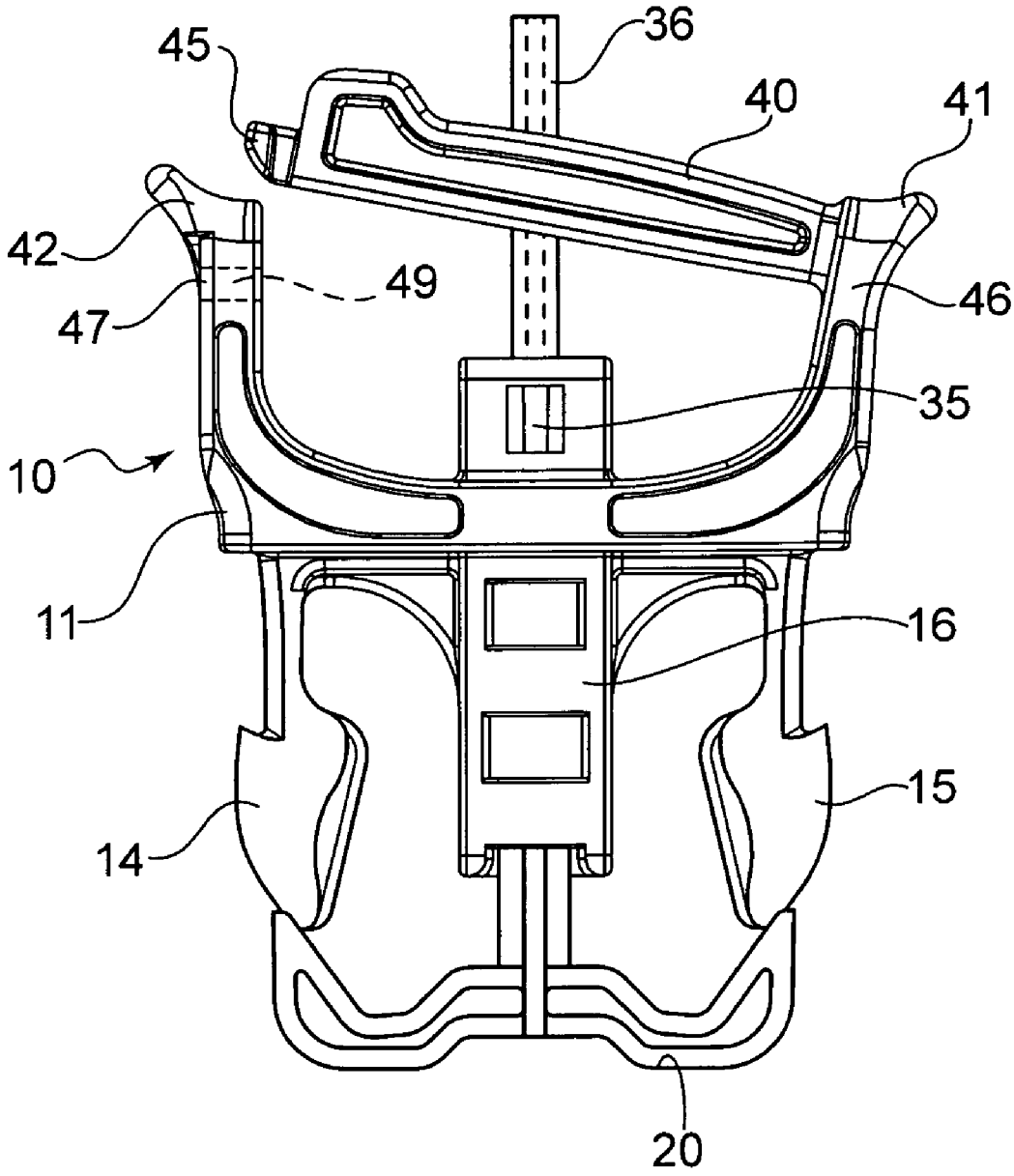
FIG. 10 shows another embodiment of the male buckle portion according to the invention.

Another embodiment of the buckle assembly is shown in FIG. 10. In this embodiment, the rear section of male buckle portion 10 has a strap retaining bar 40, which is connected at one end to strut 46 of male buckle portion 10. At the free end of strap retaining bar 40, a latch 45 is disposed, which can be snapped into a corresponding aperture 49 in strut 47 of male buckle portion 10 to secure strap retaining bar 40 securely to male portion 10. Struts 46, and 47 are flexible so that bending the struts away from each other releases latch 45 from the aperture 49. Shoulder sections 41, 42, enable strap retaining bar to be easily unlocked, because shoulder sections 41, 42 extend beyond the width of side struts 46, 47 and provide good leverage for a user's thumbs and fingers to pry apart struts 46, 47 to release strap retaining bar 40.

Accordingly, while only a few embodiments of the present invention have been shown and described, it is obvious that many changes and modifications may be made thereunto without departing from the spirit and scope of the invention.

What is claimed is:

1. A quick-release buckle assembly, comprising:

a female portion comprising a hollow body, an open top and at least one locking slot extending through the hollow body;

a male portion comprising a base and at least one locking leg, such that inserting the male portion into the cavity through the open top of the female portion causes the at least one locking leg to engage the at least one locking slot to lock the male portion to the female portion; and a release assembly being separate from and disposed adjacent an end of the at least one locking leg and being slidable toward and away from the base, the release assembly comprising at least one arm that is adapted to contact the at least one locking leg, such that sliding the release assembly toward the base causes the at least one locking leg to be pushed toward an interior of the male portion by the arm of the release assembly and release from the at least one locking slot when the male portion has been inserted into the female portion, wherein the release assembly is connected to a pulling device that runs through the male portion, wherein pulling the pulling device causes the release assembly to slide toward the base and release the at least one locking leg from the at least one locking slot.

2. The buckle assembly according to claim 1, wherein the pulling device is a cable.

3. The buckle assembly according to claim 1, wherein the at least one locking leg has a locking element with an outer surface that widens from a tip of the locking leg toward the base, and wherein an inner surface of the at least one arm of the release assembly is sloped such that an inner contour of the release assembly widens toward the base, so that pulling the release assembly toward the base causes the outer surface of the locking element to slide along the inner surface of the arm and be pressed inward by the arm.

4. The buckle assembly according to claim 1, wherein the at least one locking leg is accessible from outside the female portion when the male portion has been inserted into the female portion, and wherein the male portion can be released from the female portion by pressing the at least one locking leg inward from outside the at least one locking slot until the at least one locking leg clears the at least one locking slot.

5. The buckle assembly according to claim 1, wherein there are two locking slots, two locking legs, and two arms on the release assembly, such that the arms press the locking legs toward each other when the release assembly is slid toward the base.

6. The buckle assembly according to claim 5, wherein the pulling device is a cable, and further comprising a central leg disposed between the two locking legs, and wherein the cable extends through the central leg to the release assembly.

7. The buckle assembly according to claim 6, wherein the pulling device is a cable and wherein the release assembly further comprises a cable guide extending from the arms into the central leg, and wherein the cable is connected to the cable guide, and wherein the cable guide slides within a channel in the central leg when the cable is pulled.

8. The buckle assembly according to claim 7, wherein the cable is releasably connected to the cable guide.

9. The buckle assembly according to claim 8, wherein the cable has an enlarged free end and the cable guide has a slot and an aperture corresponding to the enlarged free end, and wherein the cable is connected to the cable guide by sliding the release assembly toward the base until the slot and aperture extend from the central leg, and the cable is inserted through the slot until the enlarged free end rests in the aperture.

10. A buckle system comprising at least two of the buckle assemblies according to claim 2, and a single handle connected to the cables, wherein pulling the handle causes the male portions to simultaneously release from the female portions.

11. The buckle system according to claim 10, wherein there are four buckle assemblies.

12. The buckle assembly according to claim 1, wherein the male buckle portion further comprises:

two side struts connected to the base; and a strap retaining bar connected to one of the side struts, the strap retaining bar having a free end;

wherein the free end is releaseably engageable with the other of the side struts.

13. The buckle assembly according to claim 12, wherein the end of the strap retaining bar is releasably engageable with the other of the side struts by a latch on one of the strap retaining bar or other side strut, and an aperture on the other of the strap retaining bar and other side strut, the latch snapping into the aperture to secure the strap retaining bar on the other side strut.

14. The buckle assembly according to claim 13, wherein the latch is on the strap retaining bar and the aperture is on the other side strut.

15. The buckle assembly according to claim 12, wherein each of the side struts has a shoulder portion extending beyond a width of the side struts, and wherein the side struts can be moved apart from each other by pressing on the shoulder portions to release the latch from the aperture.

16. The buckle assembly according to claim 2, further comprising a cable sheath surrounding the cable, wherein the cable is slidable with the cable sheath.

* * * * *